US007966836B2

(12) United States Patent
Hosaka

(10) Patent No.: US 7,966,836 B2
(45) Date of Patent: Jun. 28, 2011

(54) COOLING STORAGE CABINET

(75) Inventor: Seiki Hosaka, Toyoake (JP)

(73) Assignee: Hoshizaki Denki Kabushiki Kaisha, Aichi (JP)

( * ) Notice: Subject to any disclaimer, the term of this patent is extended or adjusted under 35 U.S.C. 154(b) by 441 days.

(21) Appl. No.: 12/308,220

(22) PCT Filed: Jun. 20, 2007

(86) PCT No.: PCT/JP2007/062380

§ 371 (c)(1),
(2), (4) Date: Dec. 10, 2008

(87) PCT Pub. No.: WO2008/004441

PCT Pub. Date: Jan. 10, 2008

(65) Prior Publication Data

US 2009/0165476 A1 Jul. 2, 2009

(30) Foreign Application Priority Data

Jul. 3, 2006 (JP) ..... 2006-183718

(51) Int. Cl.

| | |
|---|---|
| ***G05D 23/32*** | (2006.01) |
| ***F25B 49/00*** | (2006.01) |
| ***F25D 21/00*** | (2006.01) |
| ***F25D 21/06*** | (2006.01) |

(52) U.S. Cl. ..... 62/157; 62/126; 62/150; 62/275

(58) Field of Classification Search ..... 62/126, 62/157, 275, 150, 248, 440, 176.2
See application file for complete search history.

(56) References Cited

U.S. PATENT DOCUMENTS 6,550,261 B1 4/2003 Shima et al.

FOREIGN PATENT DOCUMENTS

| | | |
|---|---|---|
| JP | 2001-174119 | 6/2001 |
| JP | 2003-083667 | 3/2003 |
| JP | 2005-164199 | 6/2005 |
| JP | 2005-300074 | 10/2005 |

OTHER PUBLICATIONS

Supplementary European Search Report dated Oct. 8, 2010 in corresponding European Application No. 07767219.4.
International Search Report mailed Sep. 4, 2007 for International Application No. PCT/JP2007/062380.

*Primary Examiner* — Chen-Wen Jiang
(74) *Attorney, Agent, or Firm* — Wenderoth, Lind & Ponack, L.L.P.

(57) ABSTRACT

One aspect of the present invention includes a cooling storage cabinet having a compressor that is included in a freezing device, a heater that is connected in parallel with the compressor to a power source, a switch that controls supply of current to the compressor, and a control unit that stops supply of current to the heater during a predetermined time after the switch operates start-up of the compressor.

18 Claims, 4 Drawing Sheets

COOLING STORAGE CABINET

TECHNICAL FIELD

The present invention relates to a cooling storage cabinet. More specifically, the present invention relates to improvement of start-up performance of a compressor at a time of starting a cooling operation.

BACKGROUND ART

A known refrigerator for commercial use (for example, see Patent Document 1) has a function to perform a defrosting operation during intervals of a cooling operation. Specifically, an evaporator and an evaporator fan are equipped in a storage compartment. The evaporator is connected to a freezing device including a compressor. On the other hand, the evaporator is equipped with a defrost heater. At a time of the cooling operation, the compressor and the evaporator fan are driven to generate cool air around the evaporator. The cool air is circularly supplied to the storage compartment to cool the storage compartment. On the other hand, the defrosting operation is performed by supplying current to the defrost heater in a state where the compressor and the evaporator fan are stopped. During this time, the temperature of the evaporator is detected and, when it reaches a predetermined temperature, it is regarded that defrosting is completed, and then the defrost heater is turned off. Thus, the defrosting operation is terminated. Then, after a lapse of a predetermined drain time, the compressor is started up first and, subsequently after a predetermined delay time, the evaporator fan is started up. Thus, the cooling operation is restarted.

Here, during the defrosting operation, since the defrost heater heats the evaporator, the refrigerant pressure (lower pressure) in the cooling circuit is increased. Where the lower pressure is increased, high starting torque is necessary at the time of start-up of the compressor and, in an event that the voltage applied to the compressor is lower because of lower power-source voltage or the like, the compressor cannot be started up or can be started up only after repeats of switching operation of the starter that is one of start-up circuit parts for the compressor. This creates a problem of shortening the life of the starter.

[Patent Document 1] Japanese Unexamined Patent Application Publication No. 2005-300074

On the other hand, the refrigerator of this type is equipped with an anti-dew heater in portions such as a front frame where dew is possibly formed. These portions are thus heated by the anti-dew heater. However, it has turned out that the anti-dew heater, which is always supplied with current in known arts, exerts not a little influence in causing decrease of the voltage applied to the compressor at the time of start-up of the compressor.

SUMMARY OF THE INVENTION

A cooling storage cabinet in accordance with the present invention includes a compressor that is included in a freezing device, a heater that is connected in parallel with the compressor to a power source, a switch that controls supply of current to the compressor, and a control unit that stops supply of current to the heater during a predetermined time after the switch operates start-up of the compressor.

With the above configuration, after the start-up operation of the compressor is performed with the switch, supply of current to the heater is stopped for a predetermined time. As a result of this, because there is no decrease of voltage accompanied with supply of current to the heater, the voltage applied to the compressor can be ensured even in an event of lower power-source voltage.

Furthermore, configurations may be as follows.

During a cooling operation to cool the inside of the cooling storage cabinet through an evaporator connected to the freezing device by driving the compressor, a defrosting operation is performed that heats the evaporator with a heating unit in a state where the compressor is stopped, and the control unit includes a function to stop supply of current to the heater for a predetermined time after the start-up operation of the compressor so that the defrosting operation is terminated and the cooling operation is restarted.

After the start-up operation of the compressor is performed in order to restart the cooling operation, supply of current to the heater is subsequently stopped for the predetermined time. Because there is no decrease of voltage accompanied with supply of current to the heater, the voltage applied to the compressor can be ensured even in the event of lower power-source voltage.

The control unit includes a start-up operation detecting section, a current blocking section, a timer section, and a supply-current restarting section. The start-up operation detecting section detects the start-up operation of the compressor. The current blocking section receives a start-up operation detection signal and blocks supply of current to the heater. The timer section outputs a time-lapse signal in a case where a predetermined time from the start-up operation detection elapses. The supply-current restarting section receives the time-lapse signal and restarts supply of current to the heater.

When the start-up operation detecting unit detects the start-up operation of the compressor, the current blocking unit receives the start-up operation detection signal and blocks supply of current to the heater. Upon a lapse of the predetermined time after the start-up operation is detected, the timer unit outputs the time-lapse signal, and the current restarting section receives the signal. Supply of current to the heater is thus restarted.

The heater is an anti-dew heater to prevent dew condensation.

The compressor has a constant rotational speed.

The compressor is an inverter compressor having a variable rotational speed.

EFFECT OF THE INVENTION

In accordance with the present invention, voltage applied to the compressor can be ensured and start-up of the compressor can be ensured even in the event of lower power-source voltage.

BEST MODE FOR CARRYING OUT THE INVENTION

Embodiment

Figure 1:
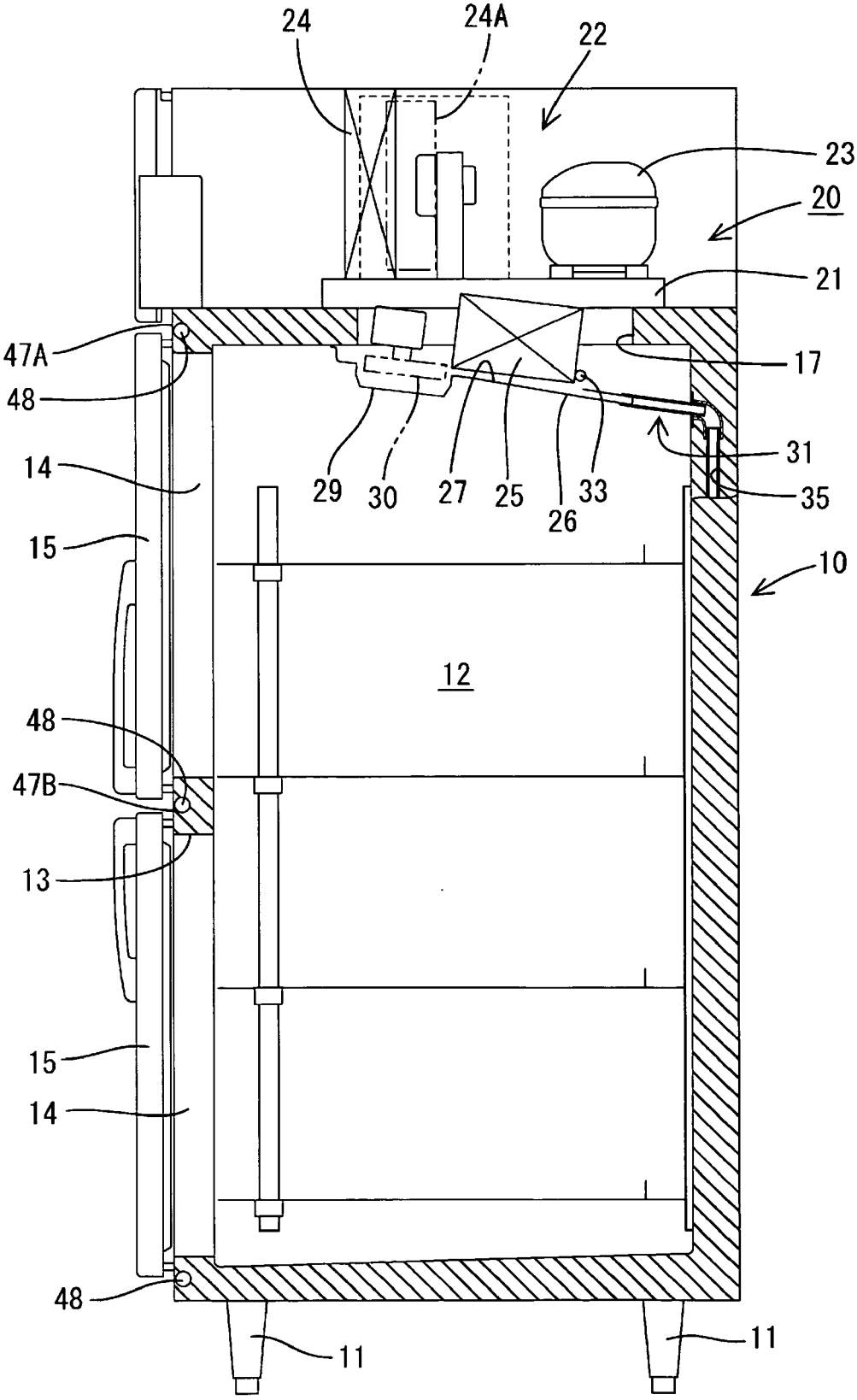
FIG. 1 is a vertical sectional view of a refrigerator of an embodiment in accordance with the present invention.

An embodiment in accordance with the present invention will be explained with reference to FIGS. 1 through 4.

Illustrated in this embodiment is a case where the present invention is adopted to an upright refrigerator for commercial use. First, a general structure of the refrigerator will be explained with reference to FIG. 1. A refrigerator body 10 is configured by a vertically elongated heat-insulating box body having an opening in the front side thereof. The refrigerator body 10 is supported by legs 11. The legs 11 are provided in four corners of a bottom face of the refrigerator body 10. The inside of the refrigerator body 10 is defined as a storage compartment 12. The front opening of the storage compartment 12 is separated with a separation frame 13 into an upper and a lower openings 14. Each of the openings 14 has a heat-insulating door 15 attached thereto. The heat-insulating doors 15 are pivotable so as to open and close the respective openings 14.

A window hole 17 is opened in a ceiling wall of the refrigerator body 10. A freezing unit 20 is installed in the top surface of the refrigerator body 10 in such a manner to close the window hole 17. The freezing unit 20 has a heat-insulating base plate 21, a freezing device 22, and an evaporator 25. The freezing device 22 is placed on the base plate 21. The evaporator 25 is hung below the base plate 21. The freezing device 22 includes a compressor 23 and a condenser 24 having a condenser fan 24A. The freezing device 22 is circularly connected to the evaporator 25 with refrigerant pipes to configure a freezing circuit, which is a known art.

A drain pan 26, which serves also as an air duct, is attached below the window hole 17 in the ceiling portion of the storage compartment 12. An evaporator chamber 27 is formed above the drain pan 26. The evaporator 25 is accommodated in the evaporator chamber 27. Furthermore, a front side (the left portion in FIG. 1) of the drain pan 26 is provided with an inlet 29 and an evaporator fan 30. A rear side of the drain pan 26 is provided with an outlet 31.

Moreover, a defrost heater 33 for a defrosting operation is installed to the evaporator 25. A drain path 35 is formed in a wall of the refrigerator body 10. The drain path 35 is connected to an outlet of the drain pan 26.

Figure 2:
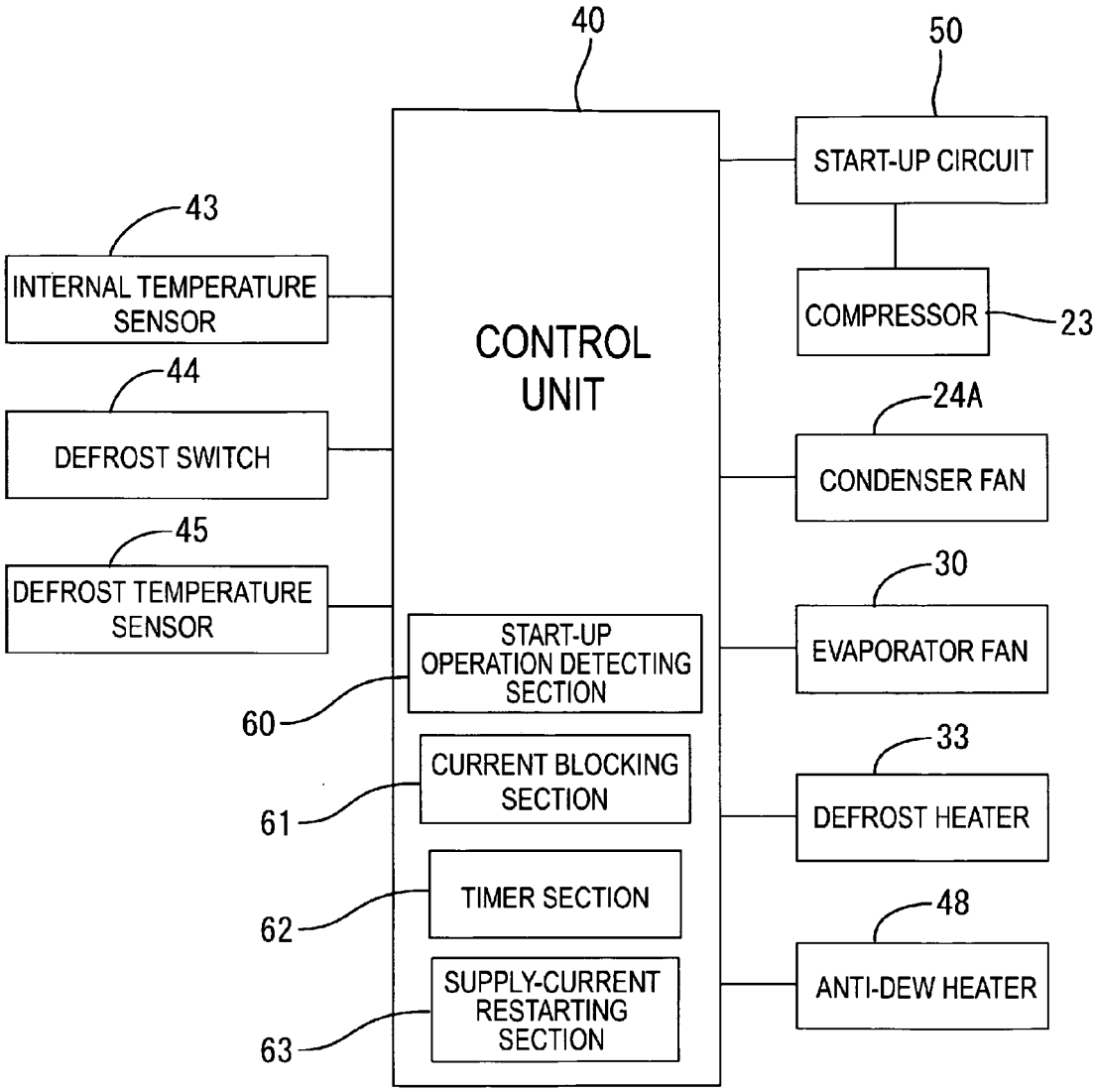
FIG. 2 is a block diagram of an operation control mechanism.

Operation of this refrigerator is controlled based on a predetermined program. For this purpose, a control unit 40 including a microcomputer, a timer, and the like is provided, as shown in FIG. 2. The program is stored in the control unit 40. Connected to the input side of the control unit 40 is an internal temperature sensor 43, a defrost switch 44 and, furthermore, a defrost temperature sensor 45. The internal temperature sensor 43 detects internal temperature of the compartment. The defrost switch 44 is operated automatically by a 24-hour timer or operated by hand. The defrost temperature sensor 45 detects the temperature of the evaporator 25 and regarding it as completion of defrost. Further, connected to the output side is a start-up circuit 50 for the compressor 23, the condenser fan 24A, the evaporator fan 30, and the defrost heater 33.

Essential operation will now be explained. A cooling operation is performed as follows. While the compressor 23 and the condenser fan 24A of the freezing device 22 are operated, the evaporator fan 30 is driven. Internal air of the storage compartment 12 is drawn by the evaporator fan 30 from the inlet 29 into the evaporator chamber 27. While the air passes the evaporator 25, cool air is generated by heat exchange. The cool air is blown out from the outlet 31 so that the cool air flows along a rear wall of the storage compartment 12. Thus, the cool air is circularly supplied to the storage compartment 12. Meanwhile, the internal temperature of the compartment 12 is detected by the internal temperature sensor 43 and, depending on whether the detected temperature is higher or lower than a predetermined set temperature, turning on and off of the compressor 23 (the evaporator fan 30) is controlled. The inside of the storage compartment 12 is thus maintained substantially at the set temperature.

During the cooling operation, the defrosting operation is performed in order to melt the frost formed on the evaporator 25 and the like. This defrosting operation is performed by supplying current to the defrost heater 33 to heat the defrost heater 33 in a state where the compressor 23, the condenser fan 24A, and the evaporator fan 30 are stopped. The defrosted water is received by the drain pan 26 and then is drained through the drain path 35 provided in the wall of the refrigerator body 10 to the outside of the refrigerator body 10 and the like. When it is regarded based on the temperature detected by the defrost temperature sensor 45 that defrosting is terminated, current to the defrost heater 33 is stopped. The defrosting operation is thus terminated, and the cooling operation is restarted.

On the other hand, for example, the back side of the two openings 14 in the front face of the refrigerator 10 has edge portions. The edge portions include the front frame 47A of the heat-insulating box body and the front plate 47B of the separation frame 13, and dew is easily formed on the back side of the edge portions. Such portions have an anti-dew heater 48 installed therein. This anti-dew heater 48 is supplied with current when a power-source switch of the refrigerator is turned on. That is, the anti-dew heater 48 is essentially always supplied with current.

Here, in order to reliably restart the cooling operation after the defrosting operation, a means for reliably starting up the compressor 23 is provided in this embodiment.

Figure 3:
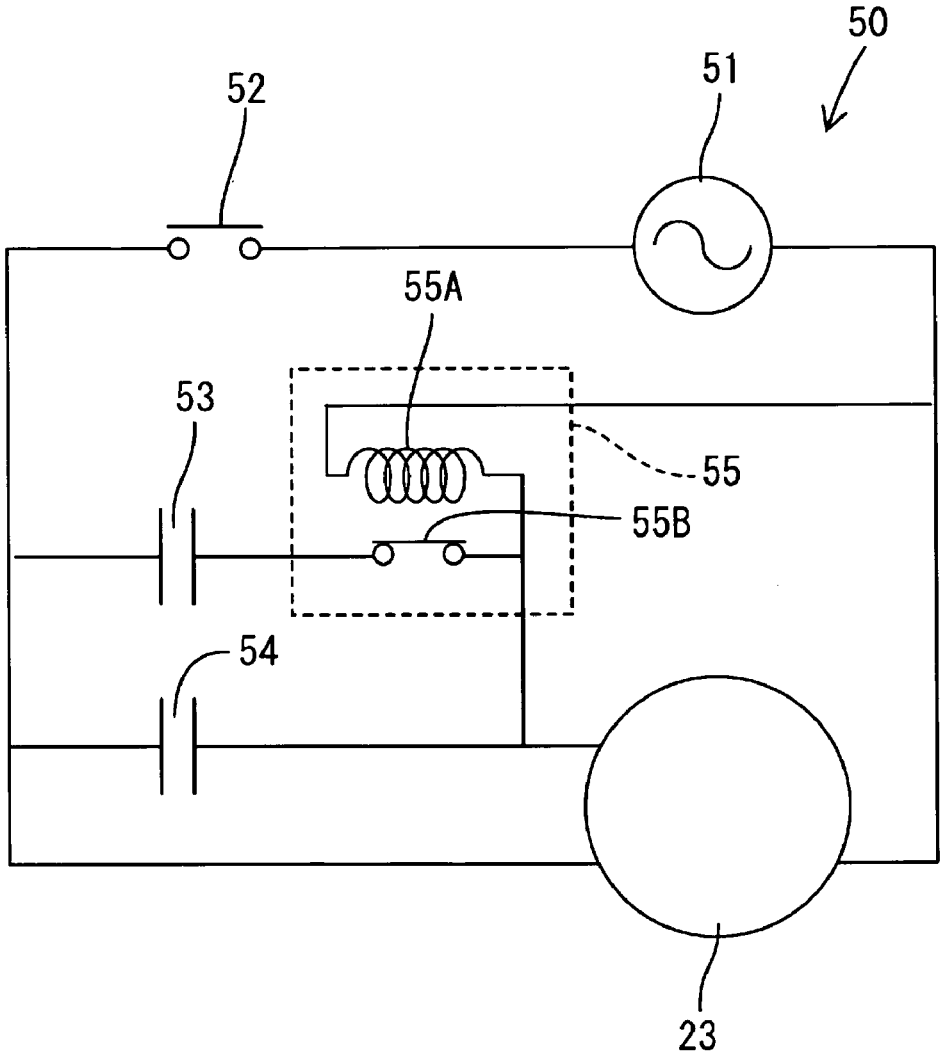
FIG. 3 is a circuit diagram of a start-up circuit of a compressor.

The start-up circuit 50 of the compressor 23 is configured as shown in FIG. 3. At a start-up timing of the compressor 23, a start-up switch 52 is closed in this start-up circuit 50. Operation from termination of the defrosting operation to restart of the cooling operation is specifically as follows. When supply of current to the defrost heater 33 is turned off and the defrosting operation is terminated, subsequently, after a lapse of a predetermined drain time (five to ten minutes), a precooling operation is performed. In the precooling operation, only the compressor 23 and the condenser fan 24A are started up. Then, after a predetermined further delay time (about five minutes), the evaporator fan 30 is started up. Thus, the cooling operation is restarted. Accordingly, the start-up timing of the compressor 23 comes after the defrost heater 33 is turned off and then the predetermined drain time elapses.

When the start-up switch 52 is closed, the voltage from a power source 51 is applied to the compressor 23 first through a start-up condenser 53 and an operation condenser 54. The compressor 23 is thus started up. Along with this, current is supplied also to a coil 55A of a bimetal PTC starter 55. After a lapse of a several seconds (for example, five to six seconds), a normally-closed starter contact 55B is opened and, thereafter, the compressor 23 is operated using only the operation condenser 54.

Essentially, in this embodiment, supply of current to the anti-dew heater 48 is stopped after the start-up operation of the compressor 23 and further for a while after the start-up circuit 50 is switched to use of only the operation condenser 54, for example for 30 seconds after the start-up operation. While the anti-dew heater 48 is connected in parallel with the compressor 23 to the power source 51, supply and stop of current to the anti-dew heater 48 is controlled based on a control signal from the control unit 40 as above.

The control unit 40 functions to detect the performed start-up operation of the compressor 23 by sending a signal to close the start-up switch 52 of the start-up circuit 50. In other words, the control unit 40 includes a start-up operation detecting section 60 that detects the start-up operation of the compressor 23. Furthermore, the control unit 40 has a function to stop supply of current to the anti-dew heater 48 upon receipt of the start-up detection signal. That is, the control unit 40 includes a current blocking section 61.

Furthermore, the control unit 40 has a function to clock 30 seconds from the detection of the start-up operation as above with a timer and, upon a lapse of the time, to output a time-lapse signal. That is, the control unit 40 includes a timer section 62. Moreover, the control unit 40 has a function to receive the time-lapse signal and restart supply of current to the anti-dew heater 48. That is, the control unit 40 includes a supply-current restarting section 63.

Figure 4:
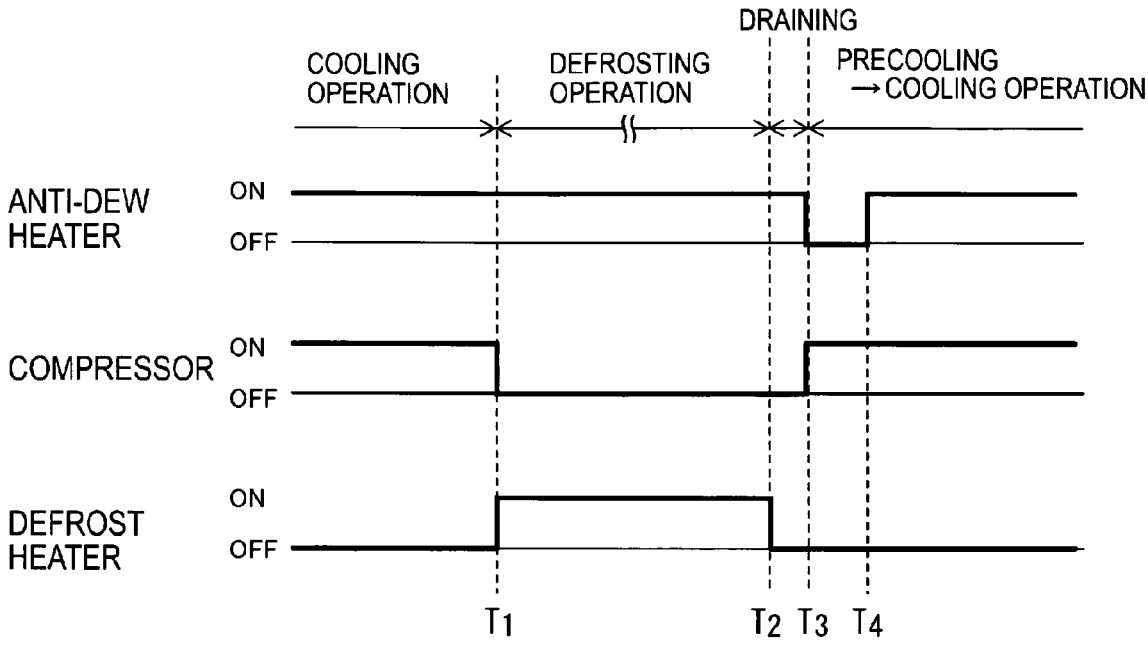
FIG. 4 is a timing chart of control of the anti-dew heater.

Working of this embodiment will be explained with reference to a timing chart of FIG. 4.

The cooling operation is performed by operating (operating control of) the compressor 23 along with the evaporator fan 30. During this operation, the anti-dew heater 48 is in a state supplied with current. At a predetermined timing T1 during the cooling operation, the operation is switched to the defrosting operation. This defrosting operation is performed by supplying current to the defrost heater 33 to heat the defrost heater 33 in a state where the compressor 23 and the evaporator fan 30 are stopped. Also during this defrosting operation, the anti-dew heater 48 is continuously in the state supplied with current. Thereafter, when it is regarded based on the temperature detected by the defrost temperature sensor 45 that defrosting is terminated, supply of current to the defrost heater 33 is turned off and the defrosting operation is terminated (a timing T2).

Thereafter, after the predetermined drain time (a timing T3), the precooling operation is started. In order to start the precooling operation, the compressor 23 is started up, i.e. the start-up switch 52 of the start-up circuit 50 is closed. Simultaneously with this, supply of current to the anti-dew heater 48 is stopped. When the start-up switch 52 is closed, as explained above, voltage from the power source 51 is applied to the compressor 23 first through the start-up condenser 53 and through the operation condenser 54, and thereby the compressor 23 is started up and, after the lapse of five to six seconds, the starter contact 55B of the starter 55 is opened. Thus, thereafter, the compressor 23 is operated using only the operation condenser 54. Then, after the start-up operation of the compressor 23, upon a lapse of 30 seconds (timing T4), supply of current to the anti-dew heater 48 is restarted.

That is, after the compressor 23 is started up and then is switched to the operation using only the operation condenser 54, during a time period of further 20 seconds and more, supply of current to the anti-dew heater 48 is stopped, and decrease of voltage is avoided to that extent. Therefore, even in an event of lower power-source voltage, the voltage applied to the compressor 23 can be ensured, and start-up of the compressor 23 and its subsequent stable operation is reliably performed. Thereafter, subsequently, the evaporator fan 30 is operated, and thus the cooling operation is executed.

Note that it has been proved that stop of supply of current to the anti-dew heater 48 to the extent of 30 seconds does not cause dew formation.

As explained above, with this embodiment, in order to restart the cooling operation (the precooling operation) after termination of the defrosting operation, supply of current to the anti-dew heater 48 is stopped for 30 seconds when the compressor 23 is started up and then switched to the operation using only the operation condenser 54. Therefore, decrease of voltage can be avoided to that extent, and the voltage applied to the compressor 23 can be ensured even in the event of lower power-source voltage. Thus, start-up of the compressor 23 and its subsequent stable operation can be ensured.

This reliably avoids such a situation when the internal temperature of the storage compartment 12 is undesirably increased due to failure of start up of the compressor 23 after the defrosting operation, i.e. failure of restart of the cooling operation.

Furthermore, because supply of current to the anti-dew heater 48 is stopped during a short time period, power consumption can be saved.

Furthermore, in a case where a start-up circuit 50 (as in this embodiment) is provided, a disadvantage as follows could be caused. That is, when the compressor 23 is started up and five to six seconds elapses, the starter contact 55B of the starter 55 is opened and the compressor 23 is switched to the operation using only the operation condenser 54. Then, if the load on the compressor 23 is heavier while the voltage applied to the compressor 23 is insufficient, over-current flows, and the bimetal overload relay (not illustrated) disposed in the start-up circuit 50 is opened. Thus, the voltage applied to the compressor 23 is shut down. After a lapse of a time, when the starter contact 55B is closed and successively the overload relay is closed, the start-up operation of the compressor 23 is again performed. However, while the load continues to be heavy, the overload relay is opened and the voltage to the compressor 23 is shut down in the same manner with the above; subsequently, that action may be repeated until, for example, the load becomes light enough to allow the compressor 23 to succeed in start-up. During these repeats, switching of the starter contact 55B of the starter 55 is also repeated as many as the number of repeats of the action as above.

To the contrary, in this embodiment, switching of the starter 55 accompanied with the start-up operation of the compressor 23 (switch of the starter contact 55B) is required only once. Therefore, the life period of the starter 55 can be considerably longer.

Other Embodiments

The present invention is not limited to the embodiment as explained above with reference to the drawing. For example, the following embodiments are included within the scope of the present invention. Furthermore, further various configurations other than the following embodiments are also possible within the scope and spirit of the invention.

(1) Illustrated in the above embodiment is a case where the control to stop supply of current to the anti-dew heater for 30 seconds is incorporated in a program to control the operation of the refrigerator. An external timer may be provided whereby the stop control of the anti-dew heater is operated.

(2) The "30 seconds" of the supply-current stop time of the anti-dew heater shown in the above embodiment is just an illustration. Any desired time may be selected at will, taking into consideration circumstances such as the type of a compressor and the condition of dew formation.

(3) The present invention can be adopted also to a refrigerating showcase having an anti-dew heater for a glass door.

(4) In the above embodiment, a compressor having a constant rotational speed is illustrated as the compressor. The compressor may be an inverter compressor having variable rotational speeds.

(5) Furthermore, this invention is effective even if adopted to a case where higher starting torque is required. For example, such higher starting torque is required when starting so-called pull-down cooling. The pull-down cooling is performed when first starting up the refrigerator after installation at a place, when restarting the refrigerator after long rest for maintenance, and the like.

The invention claimed is:

1. A cooling storage cabinet, comprising:

a compressor that is included in a freezing device;

a heater that is connected in parallel with the compressor to a power source;

a switch that controls supply of current to the compressor; and a control unit that stops supply of current to the heater during a predetermined time after the switch operates start-up of the compressor.

2. The cooling storage cabinet according to claim 1, wherein during a cooling operation to cool the inside of the cooling storage cabinet through an evaporator connected to the freezing device by driving the compressor, a defrosting operation is performed that heats the evaporator with a heating unit in a state where the compressor is stopped, and the control unit includes a function to stop supply of current to the heater for a predetermined time after the start-up operation of the compressor so that the defrosting operation is terminated and the cooling operation is restarted.

3. The cooling storage cabinet according to claim 2, wherein the control unit includes a start-up operation detecting section, a current blocking section, a timer section, and a supply-current restarting section, wherein the start-up operation detecting section detects the start-up operation of the compressor, the current blocking section receives a start-up operation detection signal and blocks supply of current to the heater, the timer section outputs a time-lapse signal in a case where a predetermined time from the start-up operation detection elapses, and the supply-current restarting section receives the time-lapse signal and restarts supply of current to the heater.

4. The cooling storage cabinet according to claim 3, wherein the heater is an anti-dew heater to prevent dew condensation.

5. The cooling storage cabinet according to claim 4, wherein the compressor has a constant rotational speed.

6. The cooling storage cabinet according to claim 4, wherein the compressor is an inverter compressor having a variable rotational speed.

7. The cooling storage cabinet according to claim 3, wherein the compressor has a constant rotational speed.

8. The cooling storage cabinet according to claim 3, wherein the compressor is an inverter compressor having a variable rotational speed.

9. The cooling storage cabinet according to claim 2, wherein the heater is an anti-dew heater to prevent dew condensation.

10. The cooling storage cabinet according to claim 9, wherein the compressor has a constant rotational speed.

11. The cooling storage cabinet according to claim 9, wherein the compressor is an inverter compressor having a variable rotational speed.

12. The cooling storage cabinet according to claim 2, wherein the compressor has a constant rotational speed.

13. The cooling storage cabinet according to claim 2, wherein the compressor is an inverter compressor having a variable rotational speed.

14. The cooling storage cabinet according to claim 1, wherein the heater is an anti-dew heater to prevent dew condensation.

15. The cooling storage cabinet according to claim 14, wherein the compressor has a constant rotational speed.

16. The cooling storage cabinet according to claim 14, wherein the compressor is an inverter compressor having a variable rotational speed.

17. The cooling storage cabinet according to claim 1, wherein the compressor has a constant rotational speed.

18. The cooling storage cabinet according to claim 1, wherein the compressor is an inverter compressor having a variable rotational speed.

* * * * *